US006473592B2

(12) United States Patent
Nishio

(10) Patent No.: US 6,473,592 B2
(45) Date of Patent: Oct. 29, 2002

(54) SHEET CONVEYING APPARATUS WITH CURL CORRECTION AND IMAGE FORMING APPARATUS HAVING SAME

(75) Inventor: Masato Nishio, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/819,744

(22) Filed: Mar. 29, 2001

(65) Prior Publication Data

US 2001/0033762 A1 Oct. 25, 2001

(51) Int. Cl.[7] ..... G03G 15/00
(52) U.S. Cl. ..... 399/406
(58) Field of Search ..... 399/406; 162/270, 162/271; 271/188

(56) References Cited

U.S. PATENT DOCUMENTS 5,270,778 A * 12/1993 Wyer ..... 399/406
5,357,327 A * 10/1994 Solano et al. ..... 399/406
5,920,759 A 7/1999 Ushiroji et al. ..... 399/406
5,978,645 A * 11/1999 Miyazaki ..... 399/406
6,094,561 A * 7/2000 Ushio ..... 399/406 X
6,259,888 B1 * 7/2001 Kazama et al. ..... 399/406

* cited by examiner

*Primary Examiner*—Fred L. Braun
(74) *Attorney, Agent, or Firm*—Fitzpatrick, Cella, Harper & Scinto

(57) ABSTRACT

A sheet conveying apparatus has a roller together with first and second rotary members abutting against an outer periphery of the roller to form, respectively, first and second nips through which a sheet passes to correct a curl in the sheet. A guide member is arranged in a central portion in an axial direction of the first rotary member so as to extend along the outer periphery of the roller to guide the sheet continuously from a position upstream of the first nip towards the second nip.

16 Claims, 9 Drawing Sheets

SHEET CONVEYING APPARATUS WITH CURL CORRECTION AND IMAGE FORMING APPARATUS HAVING SAME

BACKGROUND OF THE INVENTION

1. Field of the Invention

The present invention relates to a sheet conveying apparatus which is provided with curl correcting means for correcting a curl in a sheet and which is applicable to an image forming apparatus or the like.

2. Related Background Art

Conventionally, in an image forming apparatus, such as an electrophotographic copying machine or a printer, a toner image formed on a photosensitive drum, which serves as an image bearing member, is transferred to a sheet, and then the toner is fixed to the sheet by a fixing device provided with a fixing roller and a pressure roller held in pressure contact with the fixing roller, thereby fixing the toner image to the sheet as a permanent image. Further, in a certain type of image forming apparatus, sheets to which images have been thus fixed are sorted out by a finisher or the like so that post-processing may be easily conducted.

In such an image forming apparatus, to achieve a reduction in the size of the apparatus main body, the size of the fixing device is reduced, for example, by providing a built-in heater solely in the fixing roller, which is arranged on the image-surface side, and reducing the diameter of the pressure roller. However, in the fixing device constructed as described above, heat is imparted solely to the image-surface side, so that there is a difference in water content between the front surface and back surface of the sheet, with the result that the sheet is curled.

When the sheet is thus curled, faulty sheet transport such as jamming may be caused or the finisher etc. may not be able to function in the case where the sheet passed through the fixing device is caused to be contained in the finisher, discharge tray or the like.

To eliminate this problem of curling, a curl correcting device, such as shown in FIG. 12, has been invented, and this curl correcting device is arranged between the image forming apparatus and the finisher or the discharge tray.

Referring to FIG. 12, the curl correcting device is composed of a soft roller 51 formed of sponge or the like and a hard roller 52. The hard roller 52 is pressed against the soft roller 51 directly or through a belt (not shown) to thereby thrust the hard roller 52 into the soft roller 51, forming a curved nip N between the two rollers 51 and 52.

The sheet P is passed through this nip N while being urged so as to be wound around the hard roller 52 to thereby impart rigidity to the sheet P, thereby correcting the curl of the sheet. When the soft roller 51 is, for example, a sponge roller having an outer diameter of approximately $\phi 20$ and a rubber hardness of 25° (ASKAR C), the outer diameter of the hard roller 52 is not more than $\phi 12$, and, more preferably, $\phi 8$ or $\phi 6$, whereby appropriate curl correction is possible.

In this curl correcting device constructed as described above, the requisite pressure force with which the hard roller 52 is pressed against the soft roller 51 is approximately 50 to 60 N in total. When such pressure force is generated, deflection is apt to be created in the middle portion in the longitudinal direction of the hard roller 52, which is supported at both ends. To prevent this deflection of the middle portion in the longitudinal direction, a support member for preventing deflection is provided underneath the middle portion in the longitudinal direction of the hard roller 52. Generally speaking, silicone oil is applied to the sheet P passed through the fixing device so that the toner and the sheet P may not adhere to the fixing roller.

However, a conventional image forming apparatus provided with such a curl correcting device has a problem in that, when the curl correcting means is arranged directly on the output side of the fixing device, the length of the apparatus main body in the sheet conveying direction increases, resulting in an increase in the size of the apparatus main body. Further, in the conventional construction, in which the hard roller is pressed against the soft roller, a large torque is required for driving, with the result that the size of the curl correcting device is rather large. When the pressure force is small, it is impossible to effectively correct various types of curl.

SUMMARY OF THE INVENTION

The present invention has been made in view of the above problems. It is accordingly an object of the present invention to provide an image forming apparatus which does not involve an increase in apparatus size and which is capable of correcting curl effectively.

According to the present invention, there is provided an image forming apparatus in which an image formed on a sheet by an image forming portion is fixed to the sheet by a fixing device before the sheet is discharged, the image forming apparatus comprising a discharge path for discharging the sheet, a separation path separated from the discharge path, a surface reverse path for causing the sheet to move toward the discharge path after reversing the surfaces of the sheet conveyed to the separation path, and curl correcting means provided in the surface reverse path and adapted to correct any curl created in the sheet when it is passed through the fixing device.

DETAILED DESCRIPTION OF THE PREFERRED EMBODIMENTS

Figure 1:
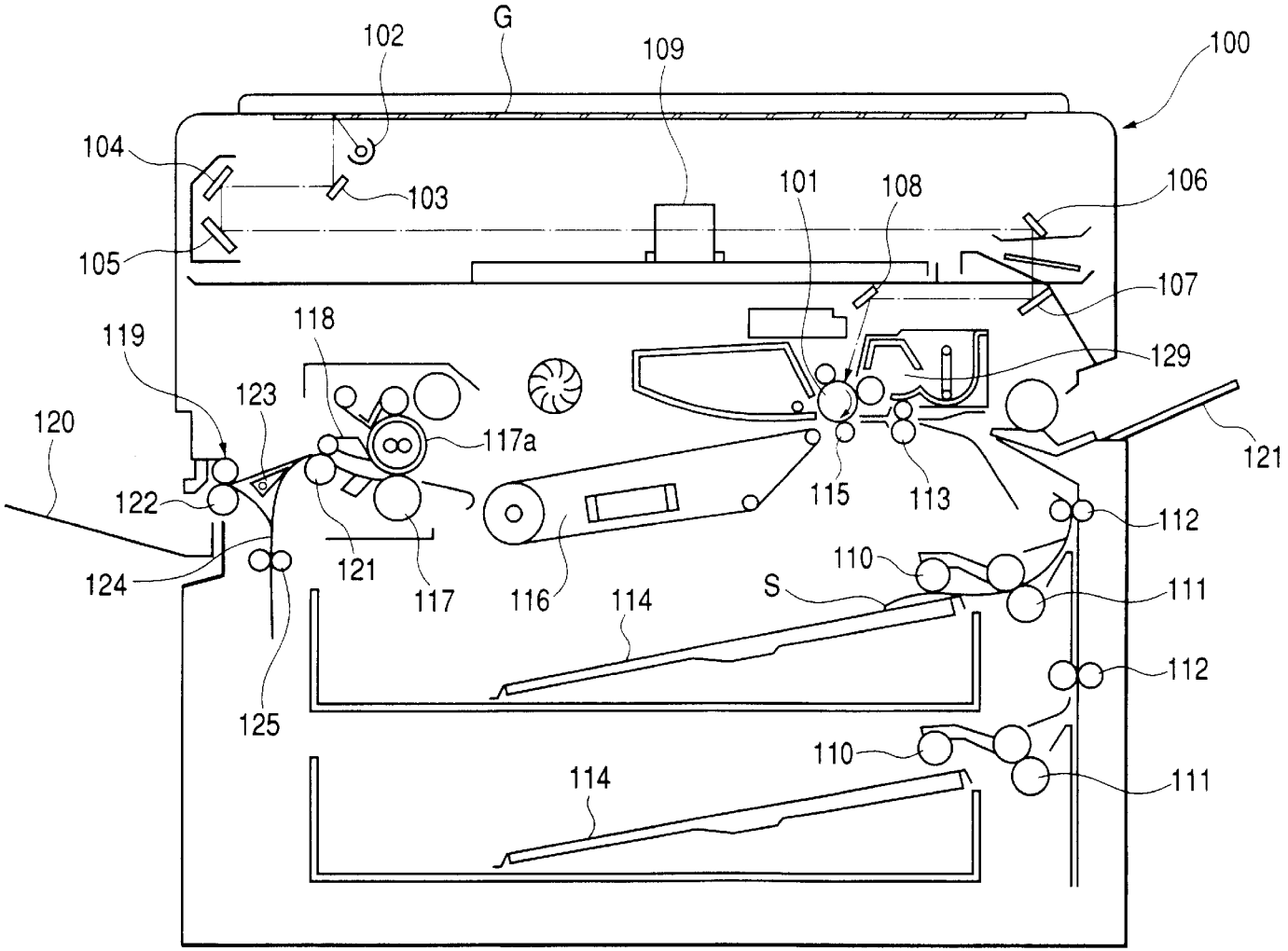
FIG. 1 is a schematic diagram showing an image forming apparatus.

FIG. 1 shows an image forming apparatus to which a sheet conveying apparatus provided with curl correcting means according to the present invention is applied. FIG. 1 is an explanatory sectional view schematically illustrating the construction of the image forming apparatus. The construction of the image forming apparatus, the image forming process, the sheet conveying state, etc. will be briefly described with reference to FIG. 1.

In a main body 100 of the image forming apparatus, a photosensitive drum 101 is rotated clockwise as indicated by the arrow in FIG. 1 at a predetermined peripheral speed (process speed). An original G is scanned by an optical lamp 102, and the reflected light is bent by mirrors 103, 104, 105, 106, 107, and 108 and then focused on the photosensitive drum 101 by a lens 109 before it is irradiated onto the photosensitive drum 101. As a result, a latent image is formed on the photosensitive drum 101, and then the latent image is developed into a toner image by a developing device 129.

Sheets S in a feed cassette 114 are separated from each other and fed one by one by a pick-up roller 110 and a separation roller pair 111, and conveyed to a registration roller pair 113 by a conveying roller pair 112.

Each sheet S is conveyed by the registration roller pair 113 to a transfer portion with a timing such that the leading end of the image on the photosensitive drum 101 matches with the leading end of the sheet S, and the toner image on the photosensitive drum 101 is transferred to the sheet S by a transfer device 115. By this image forming means, an image is formed on the sheet S.

The sheet S to which the toner image has been thus transferred is conveyed to a fixing device 117 by a conveying portion 116, and the toner image on the sheet S is fixed to the sheet S by the heat and pressure of a fixing roller pair having a fixing roller 117*a,* the sheet S being separated from the fixing roller 117*a* by a separation claw 118.

Thereafter, the sheet S is discharged to the exterior of the apparatus by a discharge portion 119. There are two ways to discharge the sheet S: face-up discharging in which the sheet is discharged with its image forming surface facing upward on a single-sided copy, and surface reverse discharging which is conducted when effecting face-down discharging.

In the face-up discharging, the sheet S discharged from the fixing device 117 is conveyed by a conveying roller pair 121 on the upstream side and passed as it is through a sheet path directly leading to discharge rollers before it is discharged from the interior of the apparatus onto a discharge tray 120 by a discharge roller pair 122.

In the surface reverse discharging, it is necessary to reverse the direction in which the sheet S is conveyed in the sheet path, and a surface reverse path portion 124 as described below is widely used for the purpose.

A switchback operation is performed as follows: the sheet path is switched by a flapper 123 driven by a solenoid or the like, and the sheet S conveyed by the conveying roller pair 121 on the upstream side is introduced into the surface reverse path portion 124, the sheet S being fed between the rollers of a surface reverse roller pair 125 and held by them. Next, the surface reverse roller pair 125 are reversely rotated to guide the sheet to the discharge roller pair 122, and the sheet S is discharged onto the discharge tray 120 from the interior of the apparatus by the discharge roller pair 122.

In such image forming apparatuses, a reduction in apparatus size and space savings have recently been promoted, and a sheet-path configuration is being widely adopted for the sheet path for conveying the sheet S discharged from the fixing device 117 in the apparatus. In this sheet path configuration, the sheet S is bent by approximately 40° to 90°.

When performing surface reverse discharging, in which the sheet S is discharged after switchback operation, the sheet S is bent by approximately 90° by the flapper 123 immediately after the heating and fixing by the fixing device 117, and guided to the surface reverse path portion 124, so that the sheet S is curled in the bending direction. When the curled sheet S is allowed to be discharged from the interior of the apparatus, defective sheet stacking on the discharge tray 120 is caused.

Figure 2:
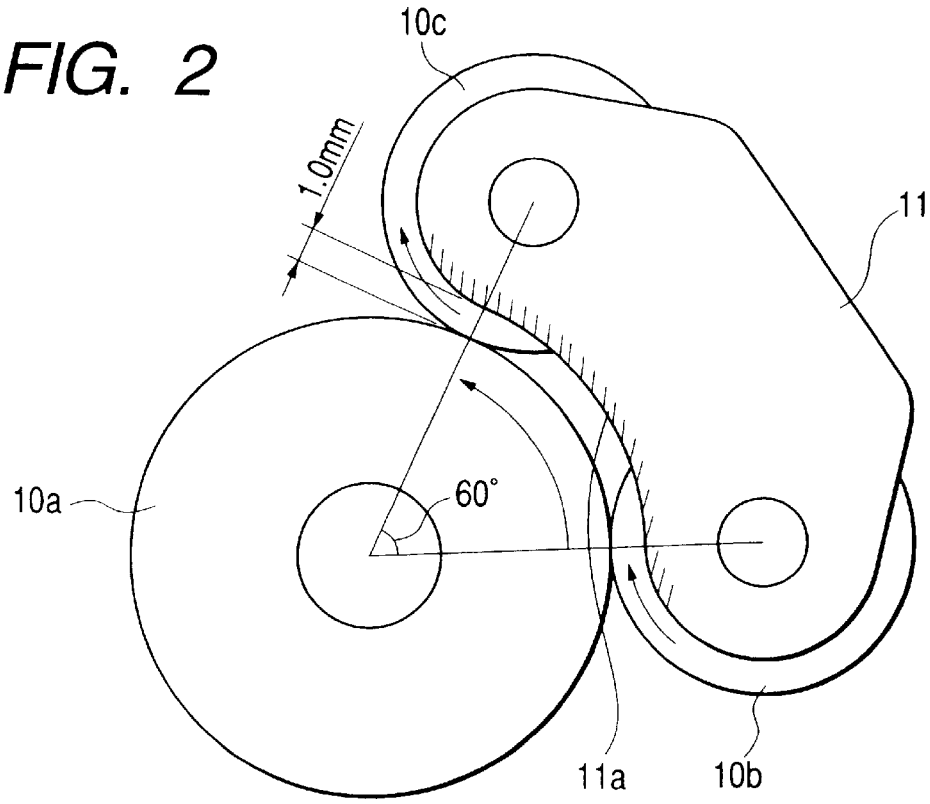
FIG. 2 is a schematic diagram showing a curl removal roller pair.

To solve this problem, as shown in FIG. 2, there is provided between the surface reverse path portion 124 and the discharge roller pair 122 (See FIG. 4) curl correcting means, which includes a roller shaft provided with a plurality of rubber rollers (rotary members) 10*a*. For each rubber roller 10*a,* there are provided two runners 10*b* and 10*c,* which serve as rotary members, or pressure rotary members, and which are in contact with the outer periphery of the rubber roller 10*a* at different positions. By passing the sheet S through the nip portion formed between the rubber roller 10*a* and the two runners serving as pressure means (inlet-side runner 10*b* and discharge-side runner 10*c*), any curl in the sheet is corrected.

The angle made by the line connecting the center of the inlet-side runner 10*b* with the center of the rubber roller 10*a* and the line connecting the center of the discharge-side runner 10*c* with the center of the rubber roller 10*a,* is 60°. The diameter of the rubber roller is $\phi 16$, the diameter of the runners is $\phi 5$, and the width of the runners is 15 mm. The rubber roller 10*a* and the runners 10*b* and 10*c* are combined to form a unit, and four such units are arranged in the longitudinal direction (axial direction).

Figure 4:
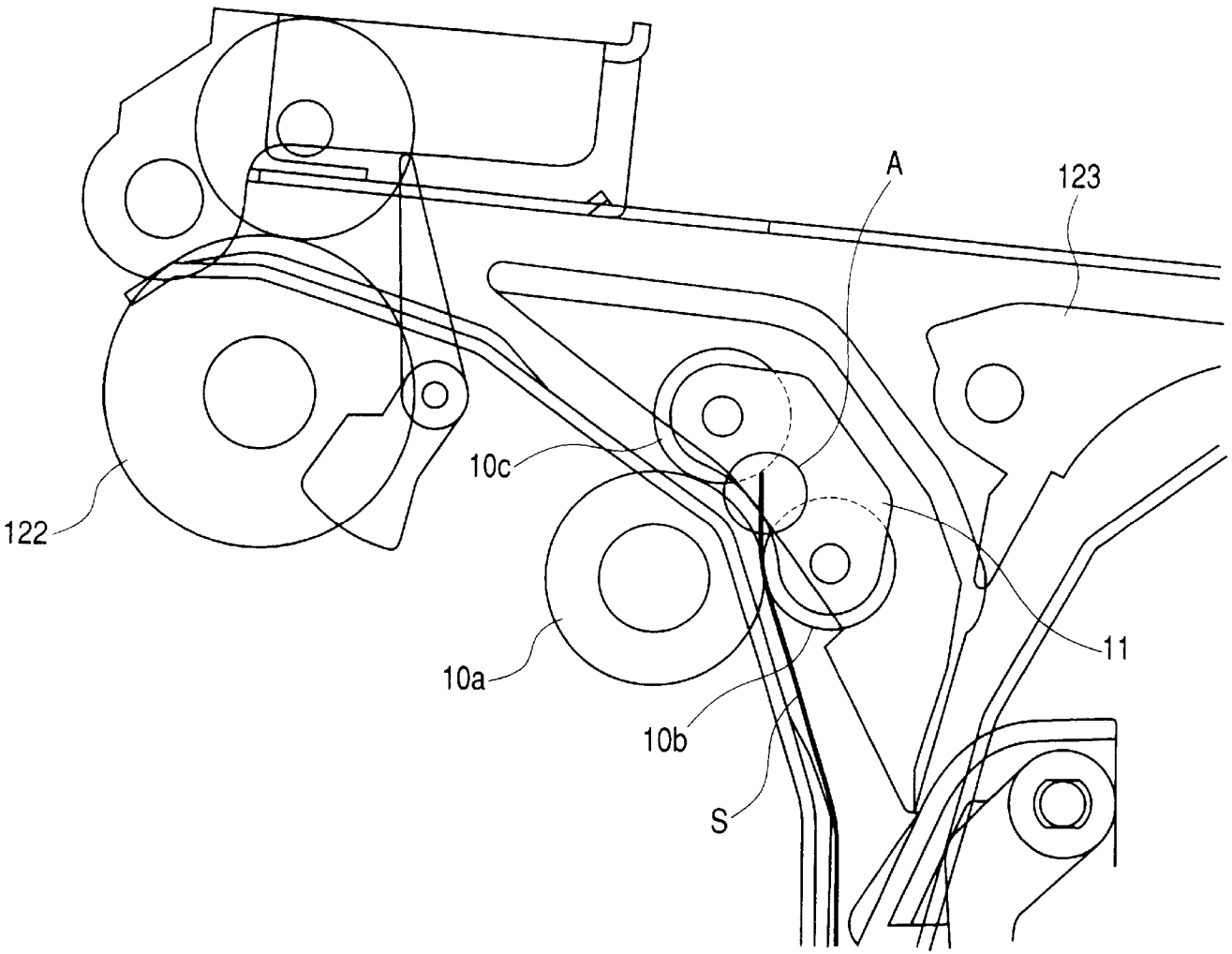
FIG. 4 is a model diagram showing how a sheet is conveyed by way of the curl removal roller pair.

In the above-described embodiment, the direction, in which the sheet S is introduced into the nip portion between the rubber roller 10*a* and the inlet-side runner 10*b* and conveyed therethrough, is perpendicular to the line connecting the center of the inlet-side runner 10*b* with the center of the rubber roller 10*a.* Thus, as indicated by the portion within the circle A of FIG. 4, when the sheet is introduced into the nip portion between the discharge-side runner 10*c* and the rubber roller 10*a,* the leading end of the sheet S collides with the discharge-side runner 10*c* before it is introduced into the nip portion, leaving a runner collision mark on the sheet S.

Figure 3:
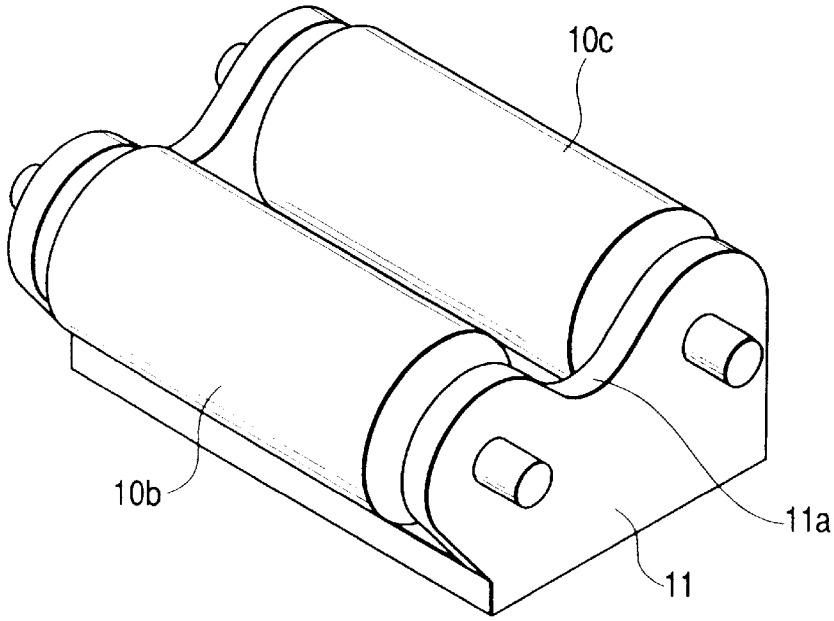
FIG. 3 is a perspective view showing driven runners of the curl removal roller pair.

To minimize this collision mark, ribs 11, which serve as the frame of the holder holding these runners 10*b* and 10*c,* exhibit a guide configuration as indicated by the shaded portion 11*a* of FIG. 2 so that the sheet S can be easily introduced into the nip portion between the rubber roller 10*a* and the discharge-side runner 10*c* (See FIG. 3).

These runners 10*b* and 10*c* are biased toward the rubber roller 10*a* by a leaf spring, the pressure force of which deforms the rubber roller 10*a* such that the holder ribs 11 having the above-mentioned guide configuration can be brought close to the nip portion to a degree that the rubber roller is not damaged. With the present configuration, the requisite distance between them is 1.0 mm at the minimum (FIG. 2).

Next, a second embodiment of the present invention will be described.

Figure 6:
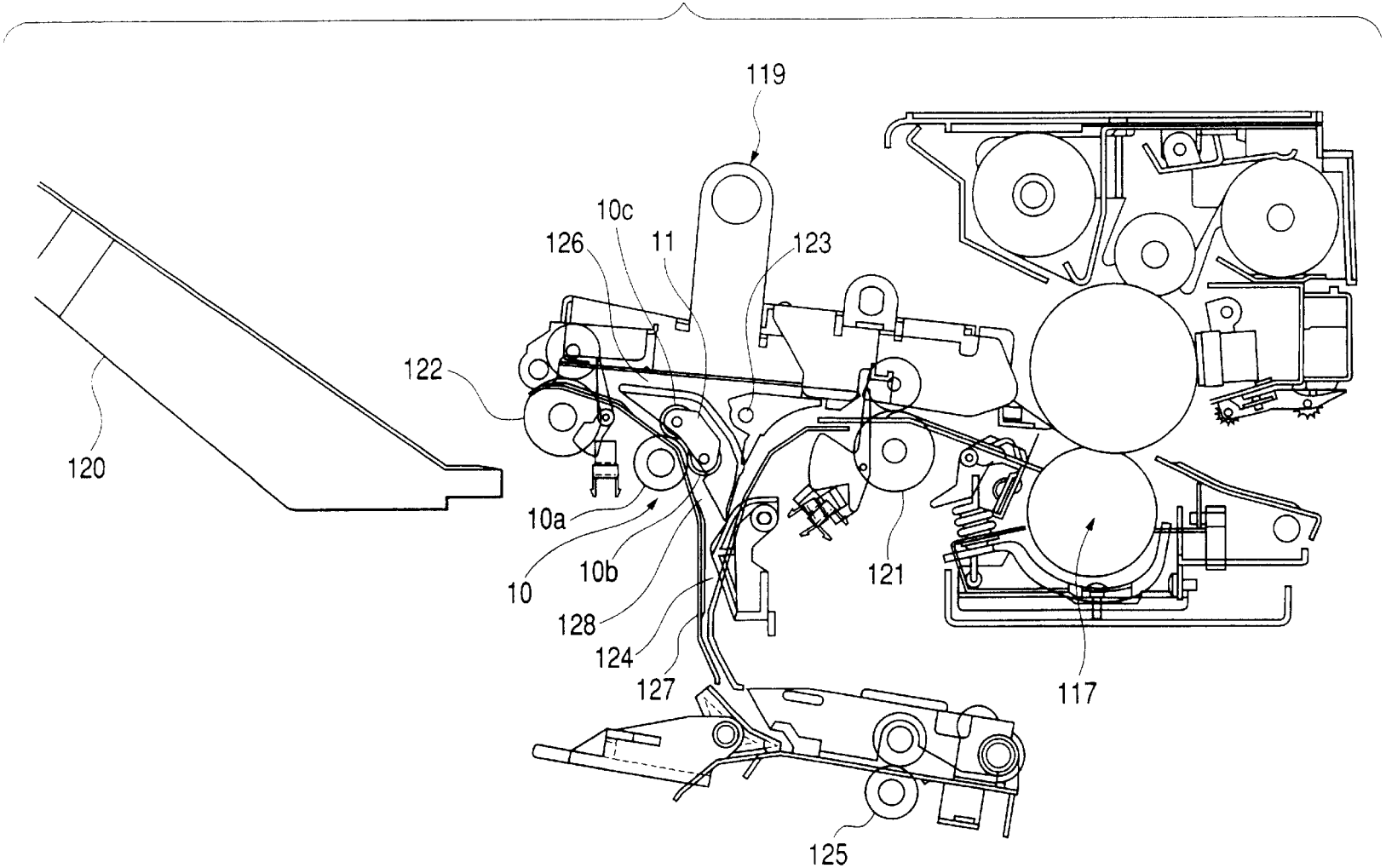
FIG. 6 is a schematic diagram showing a discharge portion of an image forming apparatus according to the second embodiment.

A discharge portion 119, shown in FIG. 6, is provided with a conveying roller pair 121 for conveying the sheet S to the discharge portion 119, a discharge roller pair 122 for discharging the sheet S onto a discharge tray (sheet stacking means) 120, and a substantially linear straight path 126 (discharge path or first path) which is a sheet conveying path extending directly from the fixing device 117 to the discharge roller pair 122.

A surface reverse path portion includes a surface reverse path 124 (separation path or second path) for effecting surface reversing by performing a switchback operation on the leading and trailing ends of the sheet S, a surface reverse discharge guide 127 forming a third path 128 for guiding the sheet S from the surface reverse path 124 to the discharge roller pair 122, and a surface reverse roller pair 125 (conveying means) which is capable of forward and reverse rotation and which is adapted to introduce and convey the sheet S in the surface reverse path 124.

Further, there are provided a flapper (branching means or switching means) 123 for switching the sheet S introduced into the discharge portion 119 between the straight path 126 and the surface reverse path 124, and a curl removal roller pair 10 serving as curl correcting means for correcting the curl generated when the sheet S is conveyed from the fixing device 117 to the surface reverse path 124.

Figure 7:
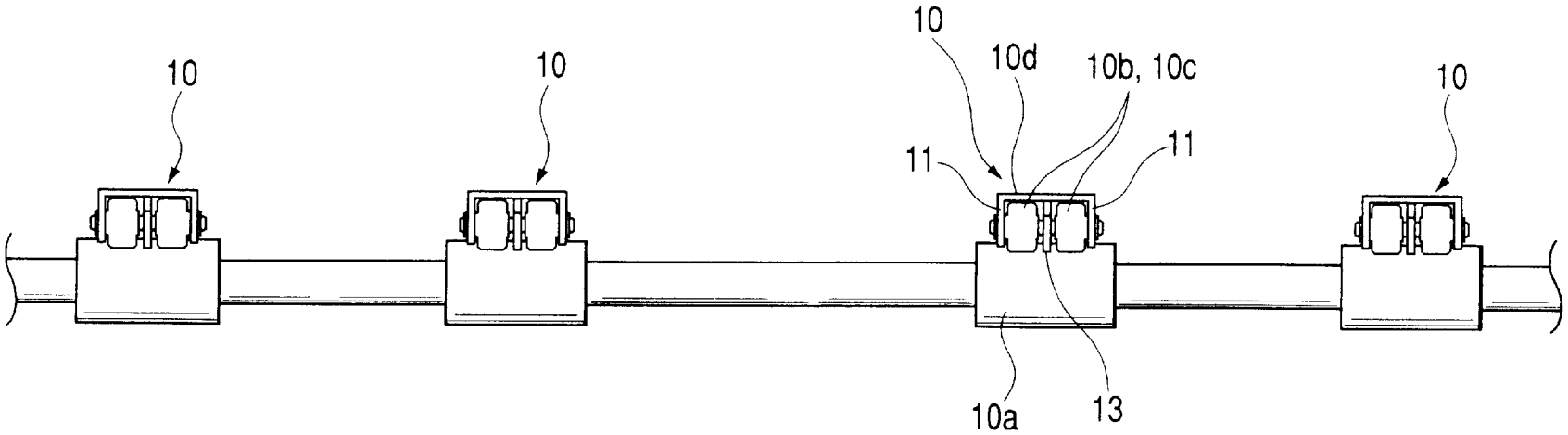
FIG. 7 is a front view showing curl removal roller pairs according to the second embodiment.

As shown in FIG. 7, four rubber portions, each having a diameter of ϕ8 and a width of 28 mm, are mounted and arranged axially on a drive shaft. Each rubber portion constitutes the driving rubber roller 10*a* (rotary member) of the curl removal roller pair 10. And, driven rollers are caused to abut the rubber portion of each driving rubber roller 10*a* with a force of 200 g by the leaf spring (not shown).

Figure 9:
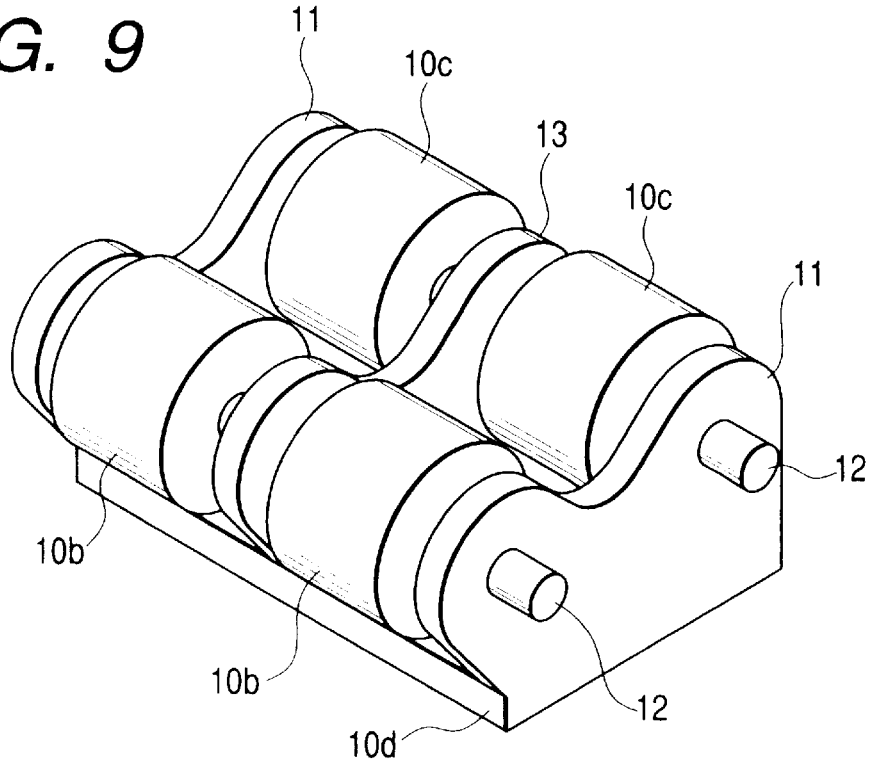
FIG. 9 is a perspective view showing driven runners of the curl removal roller pair of the second embodiment.

The driven rollers serving as the pressure means are composed of two kinds of rotary members: inlet-side driven runners 10*b* on the side where the sheet S is introduced, and discharge-side driven runners 10*c* on the side where the sheet S is discharged, and a runner holder 10*d* holding the driven runners 10*b* and 10*c*. As shown in FIG. 9, the driven runners 10*b* and 10*c* are secured to metal shafts 12 provided in the runner holder 10*d*.

If there are no curl removal roller pair 10, the amount of curl generated when a sheet of 90 g/m$^2$ is supplied and conveyed from the fixing device 117 to the surface reverse path 124 would be upwardly 18 mm in the state in which it is placed on the discharge tray 120 after passing the surface reverse discharge guide 127. Due to the provision of the curl removal roller pair 10, the amount of curl can be reduced to upwardly 11 mm.

Figure 8:
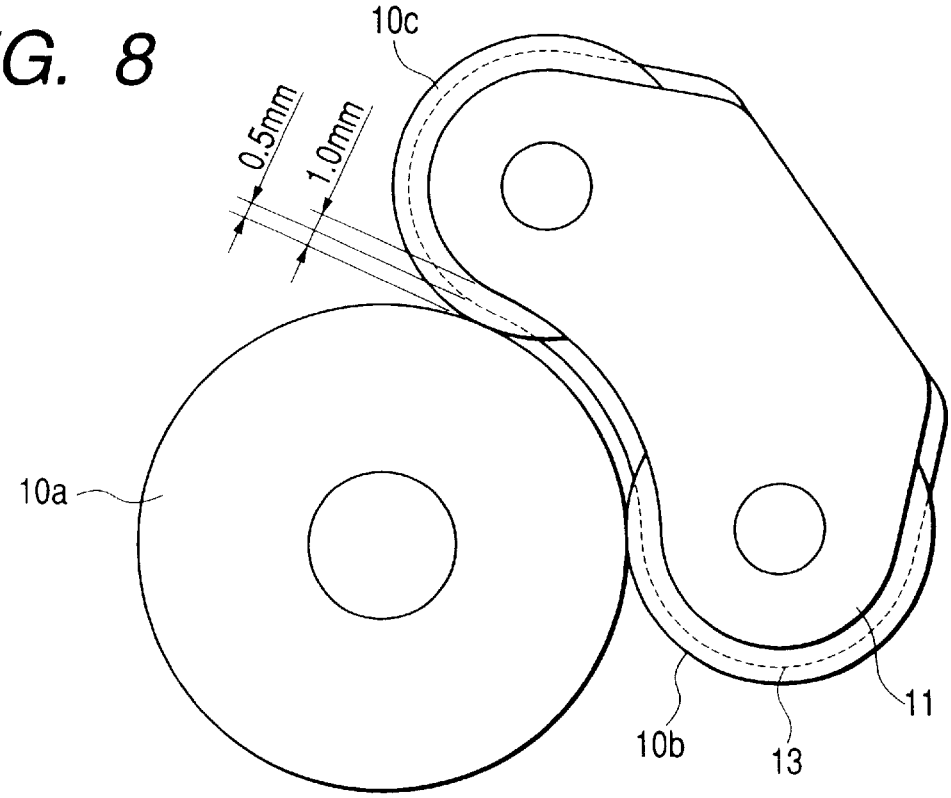
FIG. 8 is a schematic diagram showing the curl removal roller pair according to the second embodiment.

As shown in FIGS. 8 and 9, the frame of the runner holder 10*d* holding the driven runners 10*b* and 10*c* is in the form of ribs 11, which serve as the second guide members of a configuration such that they guide the sheet S from a position on the upstream side of the nip portion between the inlet-side driven runners 10*b* and the rubber roller 10*a* to the end of the nip portion between the sheet-discharge-side driven runners 10*c* and the rubber roller 10*a* so that the sheet S can be easily introduced into the nip portion between the discharge-side driven runners 10*c* and the rubber roller 10*a*.

Figure 5:
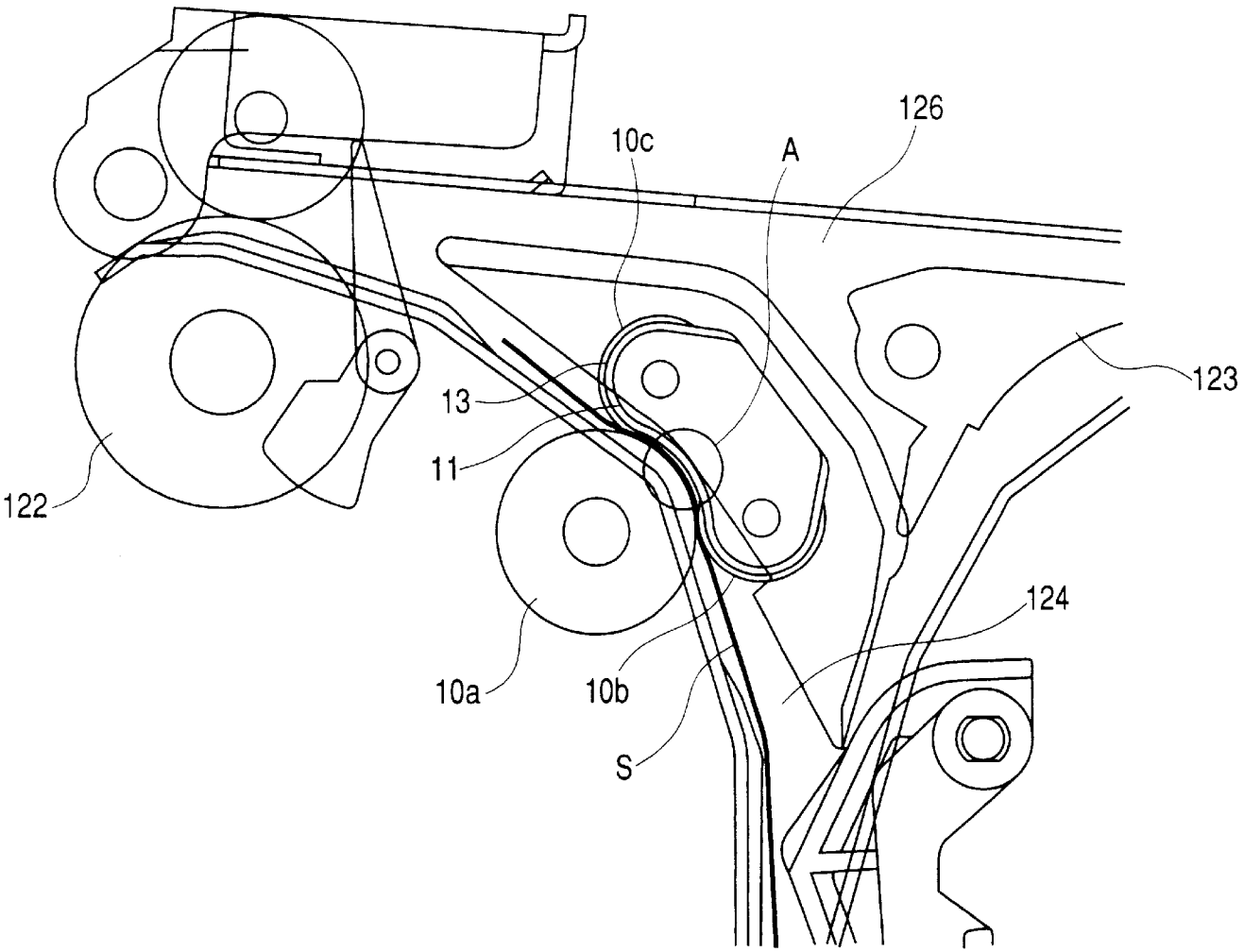
FIG. 5 is a model diagram showing how a sheet is conveyed by way of a curl removal roller pair according to a second embodiment of the present invention.

Due to the provision of the ribs 11, the sheet S is advanced in the tangential direction of the inlet-side driven runners 10*b* and the rubber roller 10*a*, and abuts against the discharge-side driven runners 10*c*, whereby it is possible to reduce to some degree the generation of a runner mark on the sheet S as shown in FIG. 5.

At this time, the driven runners 10*b* and 10*c* are in pressure contact with the rubber roller 10*a*, so that the rubber roller 10*a* is deformed. However, the portions of the rubber roller 10*a* which are near the outer sides of the ribs 11 do not receive the pressure from the side of the driven runners 10*b* and 10*c*, so that the rubber roller 10*a* is not deformed, with the result that the rubber roller 10*a* is allowed to come into contact with the ribs 11 to be thereby damaged.

To prevent this, a gap of 1.0 mm is provided between the nip portion and the ribs 11.

Further, there is provided a rib 13 serving as a first guide member, which is arranged at the center with respect to the axial direction of the runner holder 10*d*, that is, at the center with respect to the axial direction of the driven runners 10*b* and 10*c*.

The reason for providing this rib 13 is not only the same as that for providing the ribs 11 at both ends with respect to the axial direction of the runner holder 10*d*. It should also be noted that the rib 13 is placed between the driven runners 10*b* and 10*c*, so that, when the driven runners 10*b* and 10*c* are brought into pressure contact with the rubber roller 10*a* to deform the rubber roller 10*a*, the portion of the rubber roller 10*a* near the rib 13 is also deformed.

Figure 10:
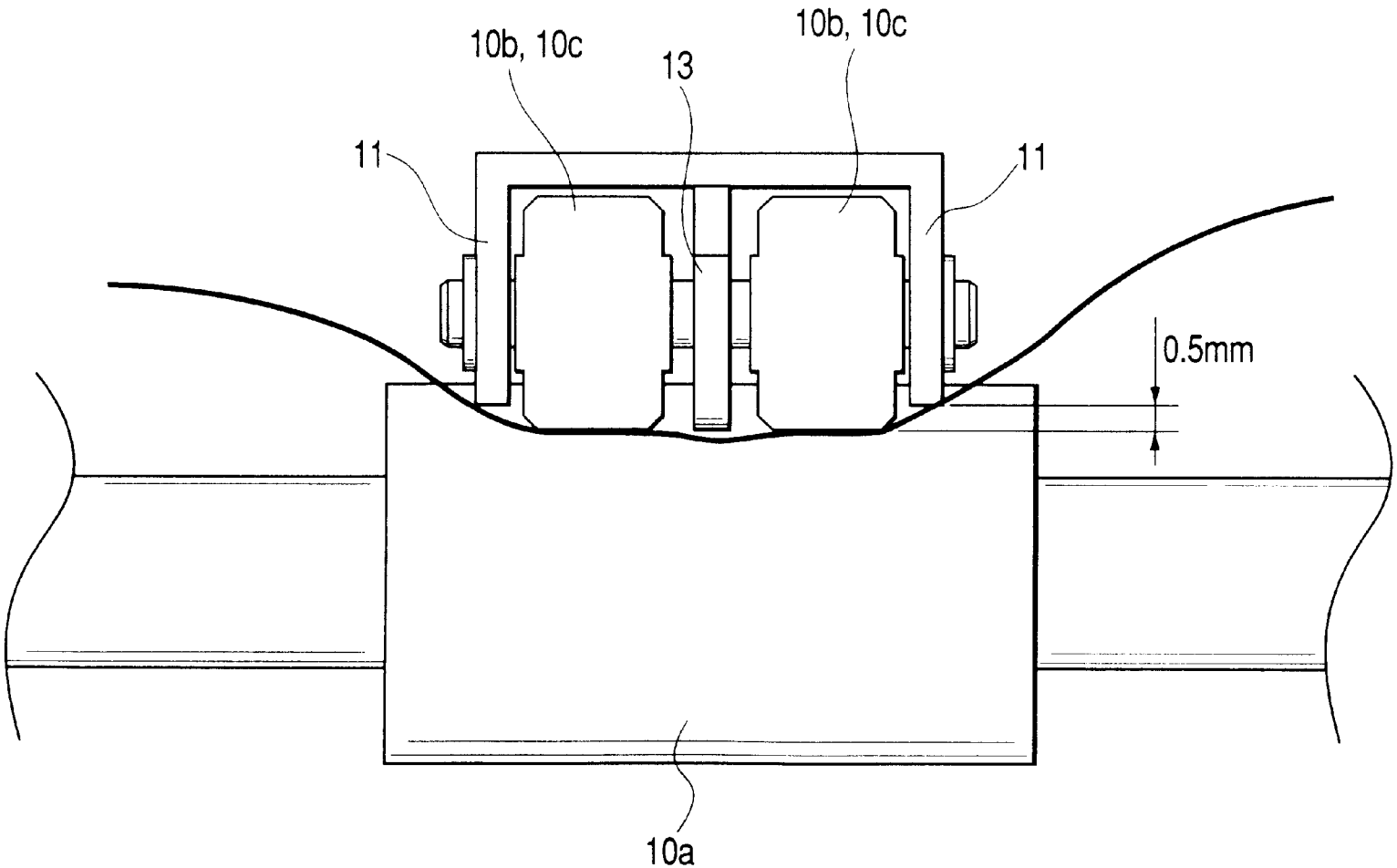
FIG. 10 is a model diagram showing how a sheet is conveyed by way of the curl removal roller pair of the second embodiment.

In view of this, the rib 13 protrudes farther toward the nip portion than the ribs 11, and the distance between the nip portion and the rib 13 is reduced to even 0.5 mm (See FIG. 10). Regarding the region A of FIG. 5 in the axial direction, it is possible, as shown in FIG. 10, for the sheet S to run along the outer periphery of the rubber roller 10*a* even at the portion near the center with respect to the axial direction of the driven runners 10*b* and 10*c* in the runner holder frame 10*d*. As shown in FIG. 5, the sheet S is smoothly introduced into the nip portion defined between the sheet-discharge-side driven runners 10*c* and the rubber roller 10*a*, so that it is possible to completely eliminate the generation of a runner mark.

Figure 11:
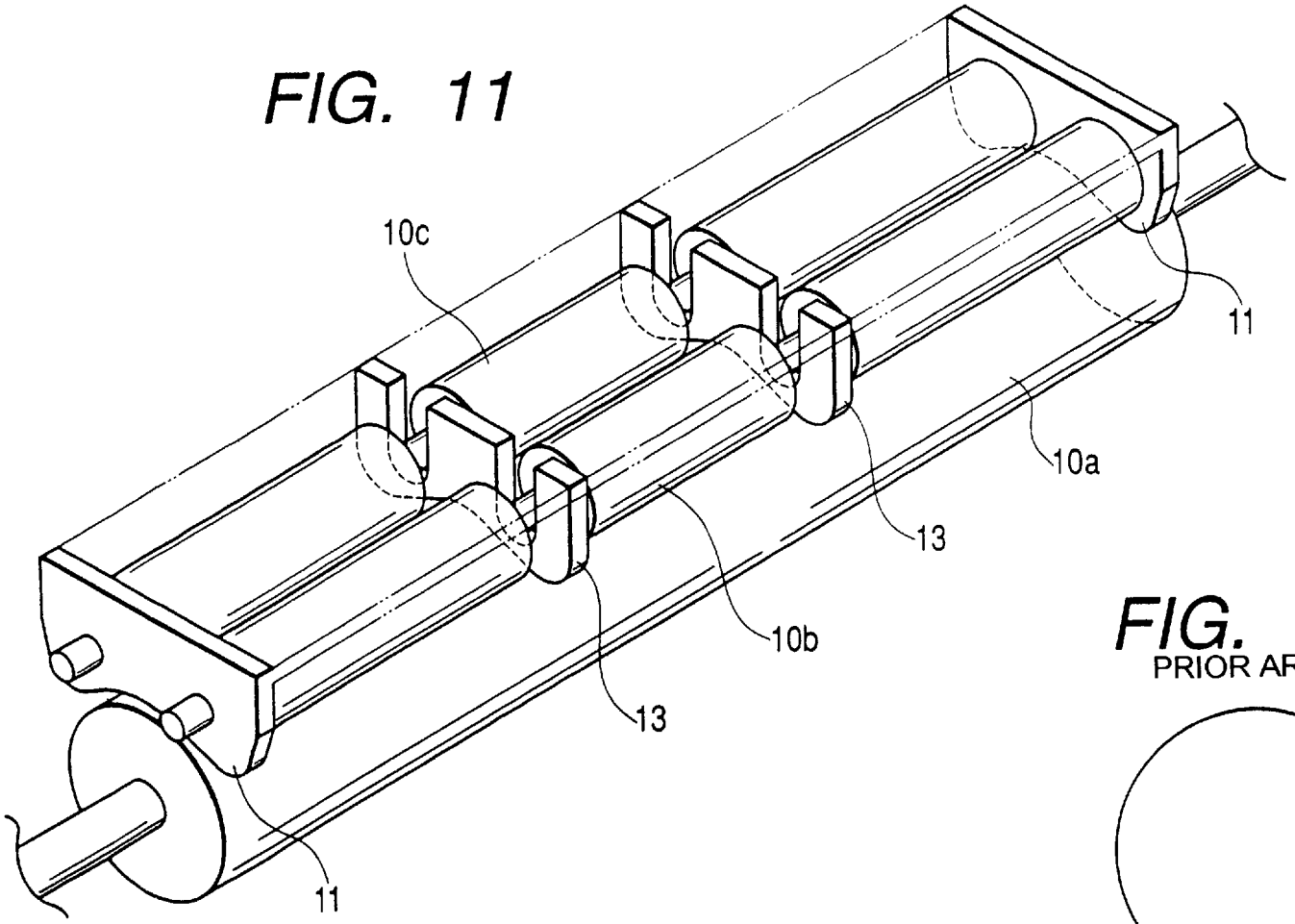
FIG. 11 is a perspective view showing a curl removal roller pair according to another embodiment of the present invention.
Figure 12:
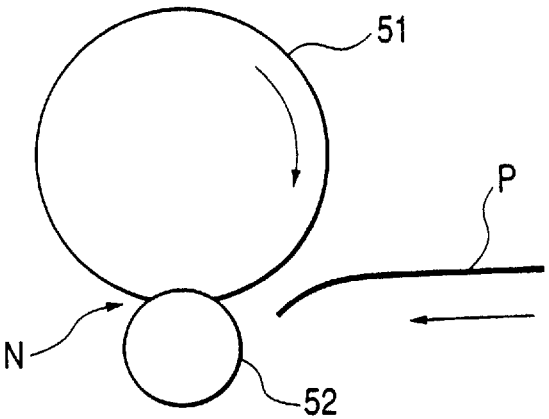
FIG. 12 PRIOR ART
FIG. 12 is a diagram showing a conventional curl removal roller pair.

While in the above-described embodiment four rubber members are mounted and arranged in the axial direction to form the driving rubber rollers 10*a*, it is also possible, for example, to adopt a driving rubber roller 10*a* extending over the entire axial range of the shaft. In this case, as shown in FIG. 11, two ribs 13 are provided in the middle portion with respect to the axial direction of the sheet-inlet-side driven runners 10*b* and the sheet-discharge-side driven runners 10*c* occupying the entire longitudinal range, whereby, as in this embodiment, the sheet S advances in the tangential direction of the inlet-side driven runners 10*b*, thereby preventing the sheet S from abutting against the discharge-side driven runners 10*c* to generate a runner mark. In this way, it is possible to adopt a construction in which a plurality of ribs 13 are provided in the central portion of the driven runners 10*b* and 10*c*.

In the sheet conveying apparatus of the present invention, there is provided a first guide member which is arranged in the central portion with respect to the axial direction of the rotary member so as to extend along the outer periphery of the rubber roller and which is adapted to guide the sheet, whereby it is possible for the first guide member to guide the sheet being conveyed, thereby preventing a mark from being left on the sheet in the central portion of the rotary member.

The first guide member continuously guides the sheet from a position on the upstream side of the nip portion of the rotary member of at least two or more rotary members which first allows passage of the sheet to the end of the nip portion of the rotary member which finally allows passage of the sheet, thereby making it possible to guide the sheet in a more satisfactory manner.

At both ends with respect to the axial direction of the rotary member, there are provided the second guide members guiding the sheet along the outer periphery of the rubber roller, and the first guide member protrudes farther toward the nip portion than the second guide members, thereby making it possible to guide the sheet in a more satisfactory manner.

The image forming apparatus of the present invention is provided with the above-described sheet conveying apparatus and image forming means for forming images, wherein the first guide member guides the sheet being conveyed so as to prevent a mark from being left on the sheet by the central portion of the rotary member.

Further, in the present invention, curl correcting means is provided in the surface reverse path, and any curl generated in the sheet when the sheet passes through the fixing device is corrected by the curl correcting means, thereby making it possible to effectively perform curl correction, without involving an increase in the size of the apparatus.

What is claimed is:

1. A sheet conveying apparatus comprising:

a roller;

a first rotary member abutting against an outer periphery of said roller to form a first nip;

a second rotary member abutting against an outer periphery of said roller to form a second nip at a downstream position of said first nip in a conveying direction, said roller, said first rotary member, and said second rotary member passing a sheet through said first nip and said second nip to correct a curl in the sheet; and a guide member arranged in a central portion in an axial direction of said first rotary member so as to extend along the outer periphery of said roller to guide the sheet continuously from a position upstream of said first nip to said second nip.

2. A sheet conveying apparatus according to claim 1, wherein said guide member is a first guide member, and further comprising second guide members provided at both ends in the axial direction of said rotary member for guiding the sheet along the outer periphery of the roller, wherein the first guide member protrudes farther toward the nip portions than the second guide members.

3. An image forming apparatus comprising:

a sheet conveying apparatus as claimed in claim 1 or 2; and image forming means for forming images.

4. An image forming apparatus which fixes an image formed on a sheet by an image forming portion to the sheet by a fixing roller before discharging the sheet, said image forming apparatus comprising:

a first path for discharging the sheet passed through said fixing roller, a second path branching off from said first path;

a third path branching off from said second path and joins into said first path;

a surface reverse roller pair for conveying the sheet introduced into said second path from said first path; and a plurality of rollers disposed at said third path for correcting a curl in the sheet being conveyed through said third path, wherein said surface reverse roller pair conveys the sheet introduced into said second path from said first path in a forward direction, then said surface reverse roller pair conveys the sheet in a reverse direction so that the sheet is introduced into said third path from said second path.

5. An image forming apparatus according to claim 4, wherein the first path discharges the sheet toward a sheet processing device for processing sheets.

6. A sheet conveying apparatus comprising:

a first path for guiding a sheet;

a second path branching off from the first path;

a flapper for selectively guiding the sheet to the first path and the second path;

a surface reverse roller pair for switchback-conveying the sheet guided to the second path by said flapper in a direction in which the sheet is introduced into the second path from the flapper and in a direction opposite thereto;

a third path for guiding the sheet switchback-conveyed in the opposite direction by the surface reverse roller pair from the second path to the first path; and a plurality of rollers for correcting a curl in the sheet passing through the third path, wherein at least a part of the flapper and at least a part of said plurality of rollers are arranged in a region divided by the first path, the second path, and the third path.

7. A sheet conveying apparatus according to claim 6, wherein said plurality of rollers comprise a first roller, a second roller, and a third roller, wherein said second roller and said third roller are pressing the sheet against said first roller to curve the sheet.

8. A sheet conveying apparatus according to claim 7, wherein said second roller and said third roller are arranged in a direction in which the sheet is conveyed.

9. A sheet conveying apparatus according to claim 7, wherein said third path extends between said first roller and said second roller.

10. An image forming apparatus comprising:

a fixing roller for fixing an image formed on a sheet by an image forming portion to the sheet;

a first path for guiding the sheet passed through the fixing roller;

a second path branching off from the first path, a flapper for selectively guiding the sheet to the first path and the second path;

a surface reverse roller pair for switchback-conveying the sheet guided to the second path by said flapper in a direction in which the sheet is introduced into the second path from said flapper and in a direction opposite thereto;

a third path for guiding the sheet switchback-conveyed in the opposite direction by the surface reverse roller pair from the second path to the first path; and a plurality of rollers for correcting a curl in the sheet passing through the third path, wherein at least a part of the flapper and at least a part of said plurality of rollers are arranged in a region divided by the first path, the second path, and the third path.

11. An image forming apparatus according to claim 10, wherein said plurality of rollers curve the sheet such that a surface of the sheet on which the image is formed faces inwardly.

12. An image forming apparatus according to claim 10, wherein said plurality of rollers comprise a first roller, a second roller, and a third roller, wherein said second roller and said third roller are pressing the sheet against said first roller to curve the sheet, and said second roller and said third roller are arranged in a region divided by the first path, the second path, and the third path.

13. An image forming apparatus according to claim 12, wherein said second roller and said third roller are arranged in a direction in which the sheet is conveyed.

14. An image forming apparatus according to claim 12, wherein said flapper is arranged in the region divided by the first path, the second path, and the third path.

15. An image forming apparatus according to claim 10, wherein said third path extends between said first roller and said second roller.

16. An image forming apparatus according to claim 10, wherein said second path branches off from said first path at a first position of said first path, and said third path joins into said first path at a second position which is located downstream of said first position.

* * * * *

UNITED STATES PATENT AND TRADEMARK OFFICE

CERTIFICATE OF CORRECTION

PATENT NO. : 6,473,592 B2
DATED : October 29, 2002
INVENTOR(S) : Masato Nishio

It is certified that error appears in the above-identified patent and that said Letters Patent is hereby corrected as shown below:

Column 3,
Line 42, “upward” should read -- upwardly --.

Column 5,
Line 15, “rotation” should read -- rotations --.
Line 39, “are” should read -- is --.
Line 45, “to” should be deleted.
Line 46, “upwardly” should read -- upwardly to --.

Column 6,
Line 4, “be thereby” should read -- thereby be --.

Signed and Sealed this

First Day of April, 2003

JAMES E. ROGAN
*Director of the United States Patent and Trademark Office*